United States Patent [19]

Hung et al.

[11] Patent Number: 4,830,736

[45] Date of Patent: May 16, 1989

[54] GRADED CATALYST SYSTEM FOR REMOVAL OF CALCIUM AND SODIUM FROM A HYDROCARBON FEEDSTOCK

[75] Inventors: Chi-Wen Hung, San Rafael; Bruce E. Reynolds, Martinez, both of Calif.

[73] Assignee: Chevron Research Company, San Francisco, Calif.

[21] Appl. No.: 890,588

[22] Filed: Jul. 28, 1986

[51] Int. Cl.[4] ..... C10G 17/00

[52] U.S. Cl. ..... 208/251 H

[58] Field of Search ..... 208/251 H

[56] References Cited

U.S. PATENT DOCUMENTS

| | | | |
|---|---|---|---|
| 2,758,060 | 8/1956 | Porter et al. | 208/251 H |
| 2,764,525 | 9/1956 | Porter et al. | 208/251 H |
| 2,970,957 | 2/1961 | Northcott et al. | 208/251 H |
| 3,696,027 | 10/1972 | Bridge | 208/251 H |
| 3,809,644 | 5/1974 | Johnson et al. | 208/251 H |
| 3,977,961 | 8/1976 | Hammer | 208/251 H |
| 3,977,962 | 8/1976 | Arey, Jr et al. | 208/251 H |
| 4,306,964 | 12/1981 | Angevine | 208/251 H |
| 4,415,436 | 11/1983 | Angevine | 208/251 H |
| 4,421,633 | 12/1983 | Shih et al. | 208/251 H |
| 4,431,526 | 2/1984 | Simpson et al. | 208/251 H |
| 4,447,314 | 5/1984 | Banta | 208/251 H |
| 4,564,439 | 1/1986 | Kuehler et al. | 208/251 H |
| 4,613,425 | 9/1986 | Higashi et al. | 208/251 H |
| 4,617,110 | 10/1986 | Hinujos et al. | 208/251 H |
| 4,619,759 | 10/1986 | Myers et al. | 208/251 H |
| 4,640,765 | 2/1987 | Kubo | 208/251 H |

FOREIGN PATENT DOCUMENTS

| | | | |
|---|---|---|---|
| 537711 | 3/1957 | Canada | 208/251 H |
| 767122 | 1/1957 | United Kingdom | 208/251 H |

*Primary Examiner*—Curtis R. Davis

*Attorney, Agent, or Firm*—S. R. La Paglia; T. G De Jonghe; G. D. Haynes

[57] ABSTRACT

We provide a graded catalyst system which is used for removing calcium and sodium from hydrocarbon feed having at least 1 ppm calcium and 1 ppm sodium. It comprises two catalyst zones characterized as having decreasing porosity, increasing activity, and increasing surface to volume ratio in the direction of feed flow through the system. We also disclose a process for using it and a method for selecting catalyst for use therein.

9 Claims, 1 Drawing Sheet

GRADED CATALYST SYSTEM FOR REMOVAL OF CALCIUM AND SODIUM FROM A HYDROCARBON FEEDSTOCK

BACKGROUND OF THE INVENTION

The present invention relates to a catalyst system comprising at least two catalyst zones tailored to remove calcium and sodium from a hydrocarbon feedstock, and a process using this system. More particularly, the first zone of the catalyst system effectively removes calcium and oil-insoluble sodium while the second catalyst zone effectvely removes the oil-soluble organic sodium present in the hydrocarbon feedstock located to protect other catalysts. The process which uses this catalyst system comprises passing a calcium and sodium containing hydrocarbon feedstock over the catalyst system at hydrodemetalation conditions.

Most heavy crudes contain significant amounts of organic metal compounds such as nickel and vanadium. Some are present as insoluble salts which can be removed by conventional filtrating and desalting processes. Yet most of them are present as oil-soluble organometallics which are not removed and continue on to the catalyst bed. They create problems for refiners by depositing just below the external surface of the catalyst particles. As a result, they block the catalyst pore openings and deactivate the catalyst.

A variety of schemes to remove the oil-soluble nickel and vanadium arganometallics from petroleum feedstocks have been suggested. One approach is to frequently replace the fouled catalyst, but this is wasteful and results in costly under-utilization of the catalyst. In recent years, workers in the field have developed hydrodemetalation (HDM) catalysts to protect the more active hydrodesulfurization, hydrodenitrification, or hydrocracking catalysts. Generally, the HDM catalyst contacts the contaminated feed and the metals are deposited before the feed continues through the catalyst bed contacting the active catalysts. In particular, complicated schemes of grading varieties of catalysts which differ in pore size, support composition, and metals loading can result in more efficient use of the individual catalysts.

Most grading schemes involve contacting the hydrocarbon feedstock with a catalyst having large pores designed for metals capacity followed by catalysts with smaller pores and more catalytic metals to remove sulfur and other organic metals. In this way the contaminated feed initially contacts a less active catalyst, thereby allowing the feed to penetrate the catalyst more fully before metal deposition occurs. As the less contaminated feed continues through the catalyst bed, it contacts more active catalysts which promote the deposition of sulfur and other organic metals. Thus, for any given feedstock containing metals that penetrate to the interior of the catalyst, such as nickel and vanadium, there will be an ideal grading of catalyst which will result in the the most efficient use of these catalysts from the top of the reactor to the bottom.

A more complex problem is encountered when iron is present in the petroleum feedstock. It is present either as an oil-soluble organometallic or as an inorganic compound such as iron sulfide or iron oxide. In contrast to nickel and vanadium which deposit near the external surface of the catalyst particles, it deposits preferentially in the interstices, i.e., void volume, among the catalyst particles, particularly at the top of the hydrogenation catalyst bed. This results in drastic increases in pressure drop through the bed and effectively plugs the reactor.

In general, there are two approaches to solving the problem of oil-soluble and oil-insoluble iron deposition on the outside layer of the catalyst particles. One approach, that is somewhat effective for both types, is to control the amount of catalyst of a given size per unit volume of interstitial void volume. The object is to grade the catalyst bed with progressively smaller catalysts so as to provide a decreasing amount of interstitial void volume down the bed in the direction of oil flow. Thus the bed is tailored so as to provide more interstitial volume for iron deposits at the top of the bed than at the lower part of the bed. Hydrogenation catalysts of the same composition may be used throughout the bed; but their particle size or shape is varied from top to bottom of the bed to provide decreasing interstitial voidage volume along the normal direction of oil flow throuh the bed.

Another approach, directed to the problem of oil-soluble, organic iron deposition is to vary the amount of active hydrogenation catalyst present through the catalyst bed. The object is to increase hydogenation catalytic activity through the bed along the direction of feed flow by varying the composition of the crystalline structure of the catalyst. For example, the initial zones of catalyst contained less catalytic metals than subsequent zones. By gradually increasing catalyst activity, zone by zone, iron deposition is distributed throughout the bed. This minimizes the localized loss of voidage and therefore reduces pressure drop buildup.

Previous workers in the field have disclosed other graded catalyst systems for demetalation and desulfurization. For example, U.S. Pat. No. 3,663,434 to Bridge demetalates then desulfurizes using a graded catalyst bed ahead of a desulfurization catalyst bed. U.S. Pat. No. 3,696,027 to Bridge also demetalates and desulfurizes using a catalytic system comprising graded catalyst beds. The beds are graded to contain relatively high-macroporosity catalyst particles followed by low macroporosity catalyst particles, and relatively low hydrogenation activity catalyst particles followed by high hydrogenation catalyst particles.

Accordingly, the term "graded" is used in the art and is used herein to connote that a particular HDM catalyst bed is composed of different types of catalyst particles with differing metals capacities and hydrogenation activities to provide a gradual change through the catalyst system in the direction of feed flow. Thus, a given bed may consist of several different types of catalyst particles in terms of physical properties and chemical composition. Also, we use the term "metals capacity" to mean the amount of metals which can be retained by the catalyst under standardized conditions.

The term "macropore" is used in the art and is used herein to mean catalyst pores or channels or openings in the catalyst particles greater than about 1000 Å in diameter. Such pores are generally irregular in shape and pore diameters are used to give only an approximation of the size of the pore openings. The term "mesopore" is used in the art and used herein to mean pores having an opening of less than 1000 Å in diameter. Nesopores are, however, usually within the range of 40–400 Å in diameter.

Conventional processes, which remove nickel, vanadium, and iron, generally have decreasing macroporosity and increasing mesoporosity in the direction of feed flow through the graded bed. Previous workers found macroporosity to be strongly related to the capacity of catalyst particles to retain metals removed from a hydrocarbon feed contaminated with nickel, vanadium, and iron. In the later catalyst zones, predominantly mesoporous catalysts are preferred. These catalysts have been found to have substantially higher catalytic activity for hydrogenation compared to catalysts having lower surface areas and substantially a macroporous structure. Thus, these two phenomena can be exploited to successfully remove nickel, vanadium, and iron from heavy feedstocks in a graded catalyst system.

The complexity of the problem is again increased when metals such as calcium or sodium are present in the hydrocarbon feedstock. These metals exist in a variety of forms. They typically exist as metal oxides, sulfides, sulfates, or chlorides appearing as salts of such metals. But they can also be present as oil-soluble organometallic compounds, including metal naphthenates. The present invention particularly addresses this, the most complex, metal contaminant problem.

Conventional desalting techniques easily identify and remove the oil-insoluble metallic calcium and sodium salts. If not removed, they deposit interstitially and cause rapid pressure drop buildup. But we know the soluble organometallic compounds with less certainty. We cannot remove these calcium and sodium compounds by conventional methods. Moreover, catalyst systems, like those described above, which are effective for the removal of iron, nickel, and vanadium are unable to control the deleterious effects of oil-soluble calcium and sodium deposition.

In general, we have found that calcium deposits preferentially in the void volume among the catalyst particles. This greatly increases pressure drop through the bed and results in enormous reactor inefficiencies. In addition, we have found that sodium surprisingly behaves in a manner unlike any other metal encountered thus far. In particular, it deeply penetrates the catalyst particles. So the calcium deposits increase the pressure drop through the catalyst bed while the sodium works to block the active sites within the catalyst particles and deactivates them. As a result of our work, it has become clear that we cannot use conventional graded systems successfully to remove calcium and sodium from a hydrocarbon feedstock containing both of these metals. Thus, it is necessary for us to devise a graded catalyst system, taking into consideration such factors as shape, size, porosity, and surface activity of the catalyst particles that successfully removes both calcium and sodium from the hydrocarbon feedstock. Accordingly, it is an object of this invention to provide such a system.

SUMMARY OF THE INVENTION

This invention concerns a graded catalyst system, capable of removing calcium and sodium from a hydrocarbon feed having at least 1 ppm calcium and 1 ppm sodium. The system comprises at least two catalyst zones characterized as having decreasing porosity, increasing activity, and increasing surface to volume ratio in the direction of feed flow through the graded catalyst system.

In accordance with this invention, we disclose a process for hydrodemetalating a hydrocarbon feedstock comprising calcium and sodium compounds and reducing the rate of pressure drop buildup and catalyst deactivation using the graded catalyst system. The process comprises passing the feedstock, in the presence of hydrogen, through the first and second zones of catalyst particles at hydrodemetalating conditions.

Also in accordance with this invention, we disclose a method for selecting catalyst for use in the graded catalyst system. The method comprises five steps:

(a) measuring the amount of calcium and sodium present as oil-soluble compounds in the hydrocarbon feedstock;

(b) ranking the reactivities of said calcium and sodium oil-soluble compounds by microprobe analysis;

(c) determining from the calcium ranking, the porosity, surface activity, shape, and size of a catalyst producing desired calcium removal for specified conditions of temperature, pressure, and space velocity;

(d) determining from the sodium ranking, the porosity, surface activity, shape, and size of a catalyst producing desired sodium removal for specified conditions of temperature, pressure, and space velocity;

(e) developing a graded catalyst system which incorporates the variables determined in steps (c) and (d).

DETAILED DESCRIPTION OF THE INVENTION

Figure 1:
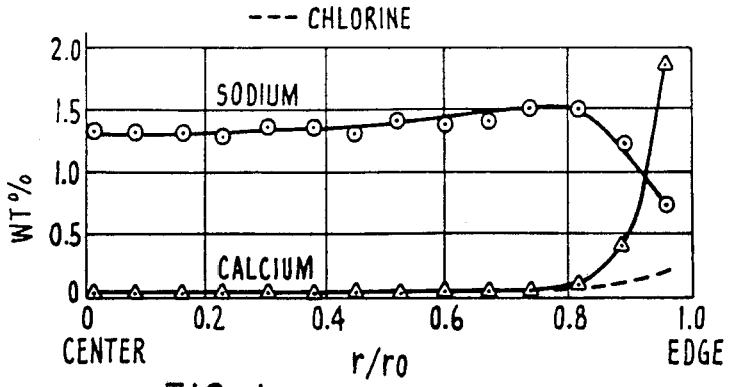
FIG. 1 shows the microprobe profile of a typical second zone catalyst.

According to the present invention, we cnntact a hydrocarbon feedstock under hydrodemetalation conditions with a catalyst system, comprising at least two catalyst zones. A first zone of the catalyst system effectively removes calcium and oil-insoluble sodium while a second catalyst zone effectively removes the oil-soluble sodium present in the hydrocarbon feedstock.

Feedstocks

The feedstocks of this invention can be any hydrocarbonaceous feedstocks that contain calcium and sodium which are dissolved therein. Significant amounts of nickel, vanadium, and iron are usually present too. They will be those feedstocks having more than 1 ppm of calcium and more than 1 ppm of sodium and preferably having more than 3 ppm of each of these metals. They will typically contain more than 20 ppm of other metals such as nickel, vanadium, and iron. In addition, they generally contain more than 1.0 wt. % sulfur and frequently more than 2.0 wt. %. The feedstocks suitable for this invention can be crudes, topped crudes, atmospheric or vacuum residua, vacuum gas oil, and liquids from synthetic feed processes, such as liquids from coal, tar sands, or oil shale. For example, we tested vacuum residua from a double desalted Shengli No. 2 crude oil obtained from the People's Republic of China which comprises about 36 ppm of calcium, about 10 ppm of sodium, and about 54 ppm of nickel, vanadium, and iron.

Catalysts

The hydrodemetalation catalyst system of this invention comprises at least two different catalyst zones. It may be desirable, however, to use more than two zones. Each zone may have a single or a series of layers of catalyst particles. We will grade the zones so that the feedstock to be hydroprocessed will contact hydrogen in the presence of a series of progressively more porous, more active HDM catalysts which have increasing surface to volume ratios.

In a two-zone system, the first zone removes calcium and oil-insoluble sodium and the second zone removes the oil-soluble organic sodium from the hydrocarbon feedstock. For particular levels of calcium and sodium present in the feedstock, we must carefully select parameters such as porosity, surface activity, shape, and size of the catalyst particles to obtain the desired grading of catalyst activity.

We can decrease porosity in the direction of feed flow among the zones of catalyst to effect catalyst grading. We prefer relatively large pores for the initial zones because contaminant metals tend to deposit onto the catalyst surface, which in time, plugs the pores of the catalyst. Larger pores facilitate the diffusion of the hydrocabon feed into the interior of the catalyst. But, in general, we decrease active surface area which results in fewer active catalyst sites.

We determine the pore size distribution within the catalyst particle by mercury porosimetry. The mercury intrusion technique is based on the principle that the smaller a given pore the greater will be the mercury pressure required to force mercury into that pore. Thus, if we expose an evacuated sample to mercury and apply pressure incrementally with the reading of the mercury volume disappearance at each increment, we can determine the pore size distribution. The relationship between the pressure and the smallest pore through which mercury will pass at the pressure is given by the equation:

$$r = -2\sigma \cos \theta / P$$

where $r$ = the pore radius $\sigma$ = surface tension $\theta$ = contact angle $P$ = pressure Using pressures up to 60,000 psig and a contact angle of 140°, the range of pore diameters encompassed is 35–10,000 Å.

In a two-zone system embodied by this invention, we characterize the catalysts for the first zone as having a pore volume distribution of at least 10%, preferably at least 15%, and most preferably 20% of its pore volume present in pores having diameters larger than 1000 Å; and a surface area ranging from about 50 $m^2/g$ to about 200 $m^2/g$, preferably from about 80 $m^2/g$ to about 150 $m^2/g$, and most preferably from about 100 $m^2/g$ to about 130 $m^2/g$.

We characterize the catalysts for the second zone as having a pore volume distribution of less than 30%, preferably less than 20%, and most preferably less than 10% of its pore volume present in pores having diameters larger than 1000 Å; and an average mesoprre diameter ranging from about 80 Å to about 400 Å, preferably from about 100 Å to about 300 Å, and most preferably from about 180 Å to about 250 Å; and a surface area ranging from about 80 $m^2/g$ to about 300 $m^2/g$, preferably about 100 $m^2/g$ to about 200 $m^2/g$, and most preferably from about 100 $m^2/g$ to about 120 $m^2/g$.

In addition, we can vary the surface activity of the catalyst zones to achieve increasing catalyst activity. We accomplish this by varying the type and amount of catalytc metals loaded onto given catalyst supports. Catalytic metals can be Group VIB or Group VIII metals from the Periodic Table according to the 1970 Rules of the International Union of Pure & Applied Chemistr. In particular, we prefer cobalt and nickel as a Group VIII metal, and molybdenum and tungsten as Group VIB metals. We use them singly or in combination, for example, cobalt-molybdenum, cobalt-tungsten, or nickel-molybdenum.

In a two-zone system, embodied by this invention, we characterize the first zone catalysts as having less than 3.5 wt. %, preferably less than 3.0 wt %, and most preferably less than 2.5 wt. % of a Group VIII metal; and less than 8.0 wt. %, preferably less than 6.0 wt. %, and most preferably less than 4.0 wt. % of a Group VIB metal impregnated onto the support.

We characterize the second catalysts of this invention as having at least 0.7 wt. %, preferably at least 1.0 wt. % and most preferably at least 1.3 wt. % of a Group VIII metal; and at least 3.0 wt. %,.preferably at least 4.0 wt. %, and most preferably at least 6.0 wt. % of a Group VIB metal.

Shape and size of the catalyst particles also affect catalyst activity. Larger sized particles inhibit metal penetration and reduce the ratio of exterior surface area to catalyst volume. But they will reduce pressure drop by increasing void fraction in the HDM bed. Catalyst particle shape also affects pressure drop, metal penetration, the ratio of exterior surface area to catalyst volume, and bed void fraction.

PREPARATION OF CATALYSTS USEFUL IN THE FIRST ZONE

We employed an alumina support in preparing typical first zone catalysts of this invention. They can be prepared by any conventional process. For example, details of preparing alumina supports of this invention are fully described in U.S. Pat. Nos. 4,392,987 to Laine et al., issued July 12, 1983, and 4,179,408 to Sanchez et al., issued Dec. 18, 1979. Both are incorporated herein by reference.

Thereafter, the catalytic agents required for typical first zone catalysts may be incorporated into the alumina support by any suitable method, particularly by impregnation procedures ordinarily employed in the catalyst preparation art. Group VIB, especially molybdenum and tungsten, and Group VIII, especially cobalt and nickel, are satisfactory catalytic agents for the present invention.

The amount of catalytic agents (calculated as the pure metal) should be in the range from about 2 to about 11 wt. % of the composition. They can be present in the final catalyst in compound form, such as an oxide or sulfide, as well as being present in the elemental form.

Details of incorporating catalytic agents into the alumina support are fully described in U.S. Pat. Nos. 4,341,625, issued July 27, 1982; 4,113,661, issued Sept. 12, 1978; and 4,066,574, issued Jan. 3, 1978; all to Tamm. These patents are incorporated herein by reference.

PREPARATION OF CATALYSTS USEFUL IN THE SECOND ZONE

We also employed alumina supports in preparing typical second zone catalysts of this invention. For example, suitable supports for these catalysts are detailed in U.S. Pat. No. 4,113,661 to Tamm, issued Sept. 12, 1978, which is incorporated by reference.

Thereafter, the catalytic agents required for these catalysts may be incorporated into the alumina support by any suitable method, particularly by impregnation procedures ordinarily employed in the catalyst preparation art. Group VIB, especially molybdenum and tungsten, and Group VIII, especially cobalt and nickel, are satisfactory catalytic agents for the present invention.

The amount of catalytic agents (calculated as the pure metal) should be in the range from about 4 to about 11 parts wt. % of the composition. They can be present in the final catalyst in compound form, such as an oxide or sulfide, as well as being present in the elemental form.

Grading

In the process of this invention the catalyst zones will be graded so that the feedstock to be hydroprocessed will contact hydrogen in the presence of a series of more active hydroprocessing catalysts. We preferentially graded them with respect to one or more of the above-discussed parameters of porosity, surface activity, shape, or size to arrive at the desired catalyst activity. At least two catalyst zones are necessary, but more than two may be desirable. For example, high activity catalysts could be mixed with low activity catalysts to create a middle zone of intermediate activity. In such a scheme, the first zone produces a first effluent stream which contacts the second zone, producing in turn a second effluent stream which contacts the third zone, which produces the demetalated effluent. Optionally, the system may also include a zone of desulfurization catalyst that is contacted by the demetalated effluent.

Hydrodemetalation Conditions

We operated the first and second catalyst zones as fixed beds. We disposed them in fluid communication in a single reactor. No other Group VIB or Group VIII metalcontaining catalytic material need be present between the two zones. For example, they can be unseparated or separated only by porous support material or reactor internals. It may be desirable, however, to include inexpensive support catalysts between the beds, such as alumina impregnated with less than 10 wt. % total metals, as metals.

The hydrodemetalation conditions of the first and second zones can be the same or different. For particularly heavy feedstocks, hydrogenation conditions should be more severe in the first zone. In general, hydrodemetalation conditions include temperatures in the range of about 500° F. to about 900° F., preferably about 600° F. to about 800° F., most preferably about 650° F. to about 770° F.; total pressures in the range of about 1000 psig to about 3500 psig, preferably from about 1200 psig to about 3000 psig, most preferably from about 1600 psig to about 2800 psig; hydrogen partial pressures in the range of 800 psig to about 2800 psig, preferably about 1000 psig to about 2500 psig, most preferably about 1500 psig to about 2200 psig; and space velocities ranging from about 0.1 to about 3.0, preferably from about 0.3 to about 2.0, most preferably about 0.5 to about 1.7.

We exemplify the present invention below. The example is intended to illustrate a representative embodiment of the invention and results which have been obtained in laboratory analysis. Those familiar with the art will appreciate that other embodiments of the invention will provide equivalent results without departing from the essential features of the invention.

EXAMPLE

We used three catalysts in the test described hereinafter. We identified them as Catalysts A, B, and C.

Catalyst A had 40% of its pore volume in the form of macropores greater than 1000 Å in diameter, and a surface area of 150 $m^2/g$. Also, it comprised 2.0 wt. % nickel. The catalyst particles were 1/16 inch diameter spheres.

Catalyst B had 40% of its pore volume in the form of macropores greater than 1000 Å in diameter and a surface area of 150 $m^2/g$. Also, it comprised 1.0 wt. % cobalt and 3.0 wt. % molybdenum. The catalyst particles were 1/16 inch diameter spheres.

Catalyst C had an average mesopore diameter of 210 Å and an average surface area of 120 $m^2/g$. Also, it comprised 1.5 wt. % cobalt and 6.5 wt. % molybdenum. The catalyst particles were 1/32 inch diameter cylinders.

We tested Catalysts A, B, and C to determine which catalysts and in what amounts would be necessary to construct a graded catalyst system for removing calcium and sodium from a hydrocarbon feedstock.

Our first step was to measure the amount of calcium and sodium, present as oil-soluble compounds, present in the specific feedstock. We chose a vacuum residua from a double desalted Shengli No. 2 crude oil obtained from the People's Republic of China for our analysis. Using conventional techniques, we determined its feed properties as summarized in Table I. In particular, we determined that it contained 26 ppm calcium and 10 ppm sodium.

TABLE 1

| Vacuum Resid Cut Used in Test | |
|---|---|
| LV % 538° C.+ (1000° F.+) | 100 |
| Sulfur, wt. % | 3.0 |
| Nitrogen, wt. % | 0.88 |
| MCRT, wt. % | 18.3 |
| Hot $C_7$ Asphaltene, wt. % | 6.5 |
| Viscosity, CS @ 100° C. | 3270 |
| Metals, ppm | |
| Ni/V | 36.0/5.1 |
| Fe | 27.1 |
| Ca | 41.7 |
| Na | 10.1 |

Next, we constructed a fixed catalyst bed. Specifically, it comprised 10 cc of Catalyst A, 10 cc of Catalyst B, and 10 cc of Catalyst C. We then contacted it, in the presence of hydrogen, with the vacuum residua at the following conditions: 1.68 LHSV, 2500 psig total pressure, 1950 psia hydrogen partial pressure, 5000 SCF/bbl, and 760° F. We operated this system for 760 hours.

After the run, we analyzed the spent catalysts by microprobe analysis. FIG. 1 shows the interval scans of Catalyst C. The data demonstrate that it had good sodium distribution. The low chlorine concentration on it indicated that the sodium deposits were not sodium chloride. Thus, the sodium had to have been present in an oil-soluble form. We noted that calcium had the worst distribution of all the metals.

Figure 2:
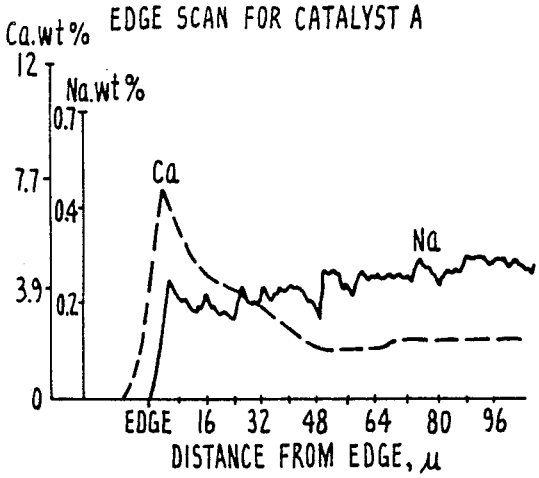
FIGS. 2, 3 and 4 show the edge scans for calcium and sodium for typical first and second zone catalysts.
Figure 3:
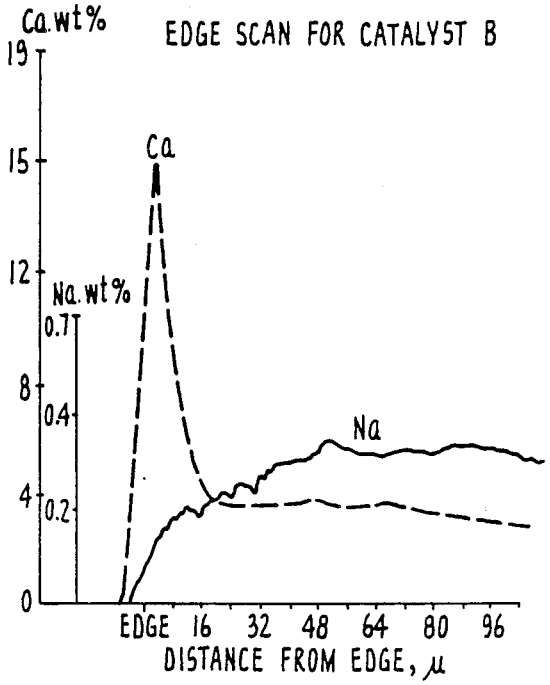
Figure 4:
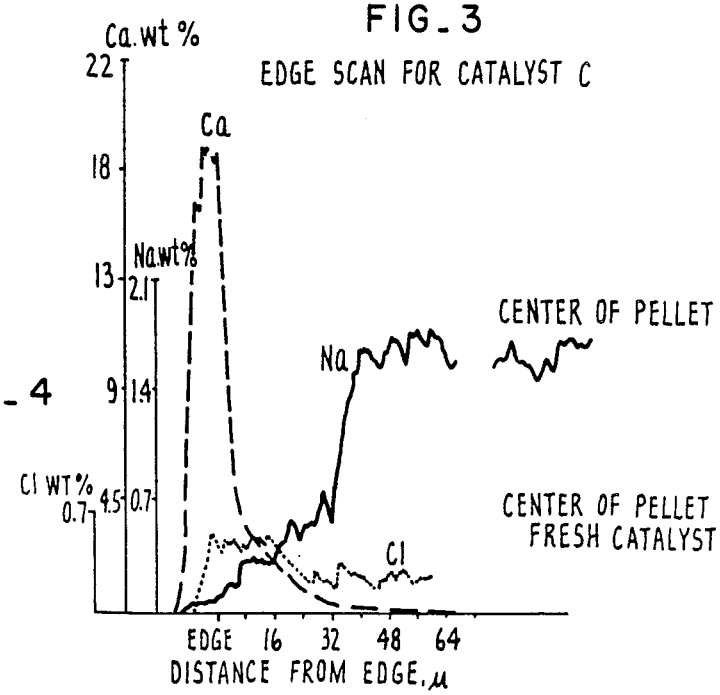

FIGS. 2, 3, and 4 compare the edge scans of sodium and calcium for A, B, and C. Catalyst C showed a higher level of sodium deposition than either A or B. This suggested to us that catalytic metals loading was an important parameter for sodium removal. Calcium deposition for A and B was very similar and was significantly deeper than for C.

Based on these results, we concluded that A and B were best suited for calcium removal. We also concluded that C was best at removing sodium, as well as nickel and vanadium. Thus, for the first zone of our graded catalyst system, we used a mixture of A and B to remove calcium. For the second zone, we used only C to remove sodium.

Based on the foregoing analysis, we used Catalysts A, B, and C to construct a two-zone catalyst system. The first zone, taking up 67 vol. % of the system, contained three layers of catalyst particles. We used Catalyst A in the first layer, which comprised 30 vol. %. For the second layer, which comprised 20 vol. %, we used a 50—50 mixture by volume of Catalyst A and Catalyst B. We used Catalyst B for the second layer, which comprised 17 vol. %. The second zone, comprising 33 vol. % of the system, contained a single layer of Catalyst C.

The purpose of the first zone, being generally macroporous, was to remove calcium as well as any other conventional heavy metals such as iron, nickel, and vanadium. The purpose of the second zone, being generally non-macroporous, was to remove sodium as well as any remaining heavy metals.

TABLE II

| Vacuum Resid Used in Second Test | |
|---|---|
| LV 538° C. + (1000° F.+) | 81 |
| Sulfur, wt. % | 2.8 |
| Nitrogen, wt. % | 0.85 |
| MCRT, wt. % | 16.0 |
| Hot $C_7$ asphaltene, wt. % | 5.7 |
| Viscosity, CS @ 100° C. | 1107 |
| Metals, ppm | |
| Ni | 31 |
| V | 4 |
| Fe | 22 |
| Ca | 58 |
| Na | 11 |

After constructing the system, we contacted it in the presence of hydrogen with the feedstock described in Table I. We used the following hydrodemetaling conditions: an LHSV of 0.54, a hydrogen partial pressure of 2000 psig, a start-of-run temperature of 750° F. After contacting the feed at these conditions, we find it to have over 70% less calcium and to be substantially free of sodium, as well as other heavy metal.

What is claimed is:

1. A process for hydrodemetalating a hydrocarbon feedstock having at least 1 ppm oil-soluble calcium and 1 ppm oil-soluble sodium, using a graded catalyst system, said process comprises:

passing said feedstock, in the presence of hydrogen, through said system at hydrodemetalating conditions, wherein said system comprises at least two successive catalyst zones characterized as follows:

(a) said first zone comprising a fixed bed of catalyst particles having at least 10 volume percent of their pore volume above 1000 Å in diameter, and a surface area ranging from about 50 $m^2/g$ to about 200 $m^2/g$, less than 3.5 wt % of a Group VIII metal, and less than 8.0 wt % of a Group VIB metal for removal of metal components from said feedstock including said oil-soluble calcium; and (b) said second zone comprising a fixed bed of catalyst particles having less than 20 volume percent of their pore volume in the form of macropores about 1000 Å in diameter, an average mesopore diameter ranging from about 80 Å to about 400 Å and a surface area ranging from about 80 $m^2/g$ to about 300 $m^2/g$, at least 0.7 wt % of a Group VIII metal, and at least 3.0 wt % of a Group vIB metal for further removal of metal components from said feedstock including said oil-soluble sodium.

2. A process, according to claim 1, wherein a first and a second catalyst zone are characterized as follows:

(a) said first zone comprising a fixed bed of catalyst particles having at least 15 volume percent of their pore volume above 1000 Å in diameter, and a surface area ranging from about 80 $m^2/g$ to about 150 $m^2/g$, less than 3.0 wt % of a Group VIII metal, and less than 6.0 wt % of a Group VIB metal; and (b) said second zone comprising a fixed bed of catalyst particles having less than 15 volume percent of their pore volume in the form of macropores above 1000 Å in diameter, an average mesopore diameter ranging from about 120 Å to about 300 Å and a surface area ranging from about 100 $m^2/g$ to about 200 $m^2/g$, at least 1.0 wt % of a Group VIII metal, and at least 4.0 wt % of a Group VIB metal.

3. A process, according to claim 2, wherein a first and a second catalyst zone are characterized as follows:

(a) said first zone comprising a fixed bed of catalyst particles having at least 20 volume percent of their pore volume above 1000 Å in diameter, and a surface area ranging from about 100 $m^2/g$ to about 130 $m^2/g$, less than 2.5 wt % of a Group VIII metal and less than 4.0 wt % of a Group VIB metal; and (b) said second zone comprising a fixed bed of catalyst particles having less than 10 volume percent of their pore volume in the form of macropores above 1000 Å in diameter, an average mesopore diameter ranging from 180 Å to about 250 Å and a surface area ranging from about 100 $m^2/g$ to about 120 $m^2/g$, having at least 1.3 wt % of a Group VIII metal, and at least 6.0 wt % of a Group VIB metal.

4. A process for hydrodemetalation and hydrodesulfurization, according to claim 1, which further comprises a third catalyst zone characterized as follows:

(a) said third zone comprising a fixed bed of catalyst particles having desulfurization activity.

5. A process, according to claim 1, wherein said hydrodemetalating conditions comprise:

(a) temperature ranging from abut 500° F. to about 900° F.;

(b) total pressure ranging from about 1000 psig to about 3500 psig;

(c) hydrogen partial pressure ranging from about 800 psig to 280 psig; and (d) space velocity ranging from about 0.1 to about 3.0.

6. A process, according to claim 5, wherein said hydrodemetalating conditions comprise:

(a) temperature ranging from about 600° F. to about 800° F.; (b) total pressure ranging from about 1200 psig to about 3000 psig;

(c) hydrogen partial pressure ranging from about 1000 psig to 2500 psig; and (d) space velocity ranging from about 0.3 to about 2.0.

7. A process, according to claim 5, wherein said hydrodemetalating conditions comprise:

(a) temperature ranging from about 650° F. to about 770° F.;

(b) total pressure ranging from about 1600 psig to about 2800 psig;

(c) hydrogen partial pressure ranging from about 1500 psig to 2200 psig; and (d) space velocity ranging from about 0.5 to about 1.7.

8. A process, according to claim 1, 2, 3, 4, 5, 6, or 7, wherein said hydrocarbon feedstock comprises at least 3 ppm oil-soluble calcium.

9. A process, according to claim 1, 2, 3, 4, 5, 6, or 7, wherein said hydrocarbon feedstock comprises at least 3 ppm oil-soluble sodium.

* * * * *